US007046767B2

(12) United States Patent
Okada et al.

(10) Patent No.: US 7,046,767 B2
(45) Date of Patent: May 16, 2006

(54) X-RAY GENERATOR

(75) Inventors: Tomoyuki Okada, Hamamatsu (JP); Yoshitoshi Ishihara, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/479,341

(22) PCT Filed: May 30, 2002

(86) PCT No.: PCT/JP02/05291

§ 371 (c)(1),
(2), (4) Date: Jun. 15, 2004

(87) PCT Pub. No.: WO02/097851

PCT Pub. Date: Dec. 5, 2002

(65) Prior Publication Data

US 2004/0218723 A1 Nov. 4, 2004

(30) Foreign Application Priority Data

May 31, 2001 (JP) ..... 2001-165020

(51) Int. Cl.
*H01J 35/15* (2006.01)
*H01J 35/00* (2006.01)

(52) U.S. Cl. ..... 378/138; 378/119

(58) Field of Classification Search ..... 378/138, 378/119, 137, 143, 43, 121, 136; 250/310, 250/311

See application file for complete search history.

(56) References Cited

U.S. PATENT DOCUMENTS 3,471,694 A * 10/1969 Poen ..... 250/310
4,219,732 A * 8/1980 Nakagawa et al. .. 250/396 ML

FOREIGN PATENT DOCUMENTS

| | | |
|---|---|---|
| JP | 58-198837 | 11/1983 |
| JP | 60-178690 | 11/1985 |
| JP | 06-325719 | 11/1994 |
| JP | 2000-149842 | 5/2000 |
| JP | 2000-277042 | 10/2000 |
| JP | 2001-124899 | 5/2001 |

* cited by examiner

*Primary Examiner*—Edward J. Glick
*Assistant Examiner*—Irakli Kiknadze
(74) *Attorney, Agent, or Firm*—Drinker Biddle & Reath LLP

(57) ABSTRACT

An object of the invention is to provide a high-resolution transmission type X-ray tube. With an X-ray imaging device according to the present invention, electron lens forming part 100A includes a central axis part 131, which is formed at the interior of a yoke 130, and an outer peripheral part 133, which defines the outer periphery of yoke 130. A part of a front end part 135 of central axis part 131 becomes a magnetic pole 110 that is positioned at the side of an electron gun. A first opening 111 is defined by magnetic pole 110. A part of a front end part 137 of outer peripheral part 133 becomes a magnetic pole 120 that is positioned at the side of a target 300. A second opening 121 is defined by magnetic pole 120. The value of diameter d2 of second opening 121 is greater than the value of diameter d1 of first opening 111.

18 Claims, 10 Drawing Sheets

X-RAY GENERATOR

TECHNICAL FIELD

The present invention concerns an X-ray generating device that may be used, for example, in non-destructive inspection.

BACKGROUND ART

An X-ray tube, an example of an X-ray generating device, is a vacuum device in which an electron beam from a cathode is accelerated by an electric field and is made to hit a target to generate X-rays by the impact. Among X-ray tubes, those in which an electron beam is made to hit one of the surfaces of a target and X-rays are radiated from the other surface of the target are called transmission type X-ray tubes. Transmission type X-ray tubes are used in non-destructive inspections, thickness measurements, X-ray analysis, etc. For example, to perform non-destructive inspection of an electronic part or other compact, high-density item, a transmission type X-ray tube is required to have a micro focusing function.

DISCLOSURE OF THE INVENTION

Among electronic parts, semiconductor mounted parts, such as a BGA (Ball Grid Array) or CSP (Chip Size Package), are being made more compact and highly integrated in recent years. In performing non-destructive inspection of such semiconductor mounted parts using a transmission type X-ray tube, the transmission type X-ray tube must be made high in resolution.

An object of this invention is to provide a high resolution transmission type X-ray tube.

The present invention provides an X-ray generating device, wherein an electron beam is made to hit one surface of a target to make X-rays be radiated from the other surface of the target, the X-ray generating device comprising: an electron beam generating means; and an electron lens forming means, including one magnetic pole positioned at the electron beam generating means side and another magnetic pole positioned at the target side and using the magnetic field generated by these magnetic poles to converge the electron beam; the one magnetic pole having a first opening from which the electron beam generated by the electron beam generating means is emitted, the other magnetic pole having a second opening into which the electron emitted from the first opening enters, and the value of the diameter of the second opening being greater than or equal to the value of the diameter of the first opening.

Methods of having an X-ray generating device high in resolution include, for example, reduction of the X-ray focal diameter, increasing of the X-ray image magnification, improvement of the image quality of the X-ray image, etc. With the present invention, since the value of the diameter of the second opening is made greater than or equal to the value of the diameter of the first opening, the electronic lens forming position can be set close to the target side. Since the electronic lens magnification can thereby be made small, the diameter of the electron beam incident on the target can be made small. Since the X-ray focal diameter can thus be made small, the X-ray generating device can be made high in resolution.

In the present invention, the other magnetic pole may have a third opening that emits the electron beam, which has entered into the second opening, towards the target and the value of the diameter of the third opening may be made smaller than the value of the diameter of the second opening.

The electronic lens (magnetic field distribution) that is made close to the target side can thereby be prevented from spreading to the other surface of the target, that is, to the both sides of the surfaces from which X-rays are radiated. As a result, the following two effects are provided. First is the effect of preventing the degradation of the performance of the measured object due to the magnetic field distribution. The other effect is that, in a case where the measured object is a magnetic object, the change of shape of the electron lens (magnetic field distribution) can be prevented and the electron beam can thus be converged appropriately.

In the present invention, the value of the diameter of the third opening may be made smaller than the value of the diameter of the first opening. Or, the value of the diameter of the third opening may be made greater than the value of the diameter of the second opening. Or, the value of the diameter of the third opening may be made equal to the value of the diameter of the first opening.

In the present invention, the one magnetic pole of the electron lens forming means may include a ferromagnetic part having a through hole, the through hole may be arranged as a path for guiding the electron beam generated by the electron beam generating means to the first opening, the through hole may have a first part, positioned at the target side and having a first diameter, and a second part, positioned at the electron beam generating means side and having a second diameter which is greater in value than the diameter of the first part, and the first part may include the first opening.

Since the value of the diameter of the first part, that is, the value of the diameter of the first opening can thus be made small, the current that is made to flow through the coil part of an electromagnet in the process of forming the electron lens can be made small.

In the present invention, the X-ray generating device may be equipped with a means that guides, to the target, only the electron beam, which, among the electron beams that enter the electron lens, passes near the center of the electron beam.

Electron beams that do not pass near the center of the electron lens is thereby cut by the above mentioned means for guiding to the target and will not reach the target. The image quality of the X-ray image can thereby be improved.

In the present invention, the X-ray generating device may be equipped with a means for keeping constant the length of the gap between the one magnetic pole and the other magnetic pole.

Since the length of the gap between the one magnetic pole and other magnetic pole can thus be kept at a fixed value, the shape of the electron lens can be made fixed. The desired X-ray focal diameter can thus be obtained.

BEST MODE FOR CARRYING OUT THE INVENTION

A favorable embodiment of X-ray generating device according to the present invention shall now be described by way of the drawings. The X-ray generating device of this embodiment is a transmission type X-ray tube.

[Outline of the Transmission Type X-ray Tube]

Figure 2:
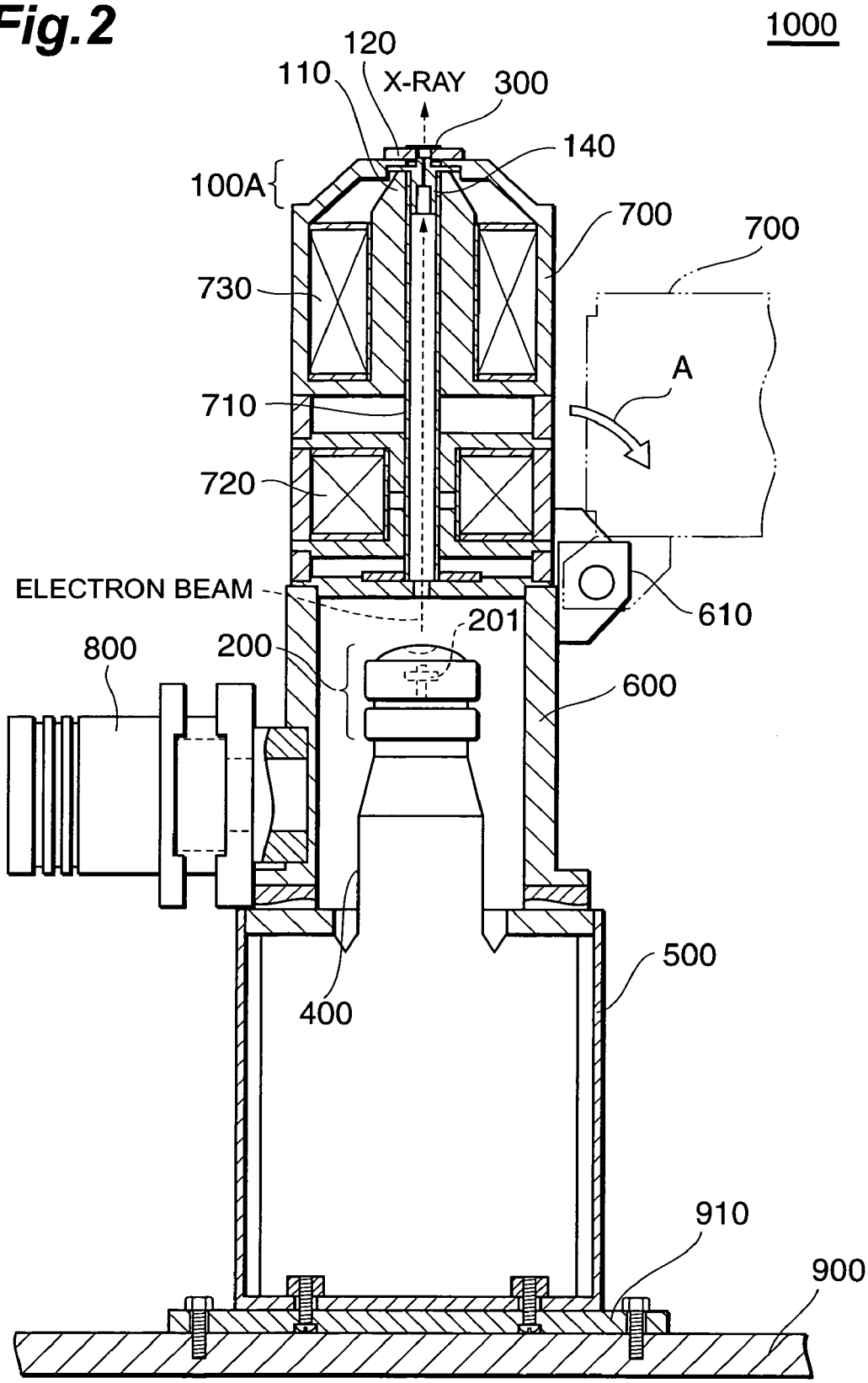
FIG. 2 is a sectional view of a transmission type X-ray tube of the embodiment.

The transmission type X-ray tube of the embodiment shall now be described in outline. FIG. 2 is a sectional view of a transmission type X-ray tube 1000. Transmission type X-ray tube 1000 is equipped with an electron lens forming part 100A, an electron gun 200, and a target 300.

The operation of transmission type X-ray tube 1000 shall now be described briefly. Electron gun 200 is an example of an electron beam generating means and includes a filament 201. An electron beam is emitted from filament 201. The electron beam is converged by electron lens forming part 100A and then the electron beam is made to hit one surface of target 300. X-rays are thereby radiated from the other surface of target 300.

The structure of transmission type X-ray tube 1000 shall now be described briefly. Transmission type X-ray tube 1000 is equipped with a power supply part 400 that is electrically connected to electron gun 200. In the present embodiment, the part at which the power supply part and the electron gun are disposed has an integral structure, this part may not be an integral structure. Power supply part 400 supplies the high voltage necessary for electron beam generation to electron gun 200 and controls the emission of electrons. Power supply part 400 is sealed by an electrically insulating resin, such as epoxy resin. Power supply part 400 is housed in a box part 500 with a part of power supply part 400 protruding outward.

Above box part 500, a cylindrical part 600 is disposed so as to surround the above mentioned part of power supply part 400. Above cylindrical part 600 is disposed a cylindrical part 700, which contains electron lens forming part 100A in its interior. During operation of transmission type X-ray tube 1000, the interiors of cylindrical parts 600 and 700 are put in a state of high vacuum. A hinge 610 is mounted to cylindrical part 700 and cylindrical part 600. Cylindrical part 700 can be moved in the direction of arrow A about the axis of hinge 610 as the rotation axis. Cylindrical part 700 can thereby be put in a tilted condition. In this condition, maintenance work, such as replacement of filament 201, etc., is performed. A pump 800 is mounted to the side face of cylindrical part 600. After replacing filament 201, etc., the interiors of cylindrical parts 600 and 700 are put in a state of high vacuum by means of pump 800. Transmission type X-ray tube 1000 can thereby be used again. Box part 500 is fixed, via a vibration absorbing plate 910, formed of rubber, etc., onto a base plate 900.

Inside cylindrical part 700, an electron beam passage tube 710 is disposed along the length direction. The electron beam emitted from electron gun 200 passes through electron beam passage tube 710 and is guided to electron lens forming part 100A. Inside cylindrical part 700, coil parts 720 and 730, which surround electron beam passage tube 710, and electron lens forming part 100A connected to electron beam passage tube 710, are disposed in that order, starting from the electron gun 200 side. Electron lens forming part 100A includes a magnetic pole 110, positioned at the electron gun 200 side, and a magnetic pole 120, positioned at the target 300 side with a predetermined gap being set with respect to magnetic pole 110. Coil part 720 and coil part 730 operate independently of each other. Coil part 720 is a condenser coil and coil part 730 is an object coil.

[Description of the Electron Lens Forming Part]

Figure 1:
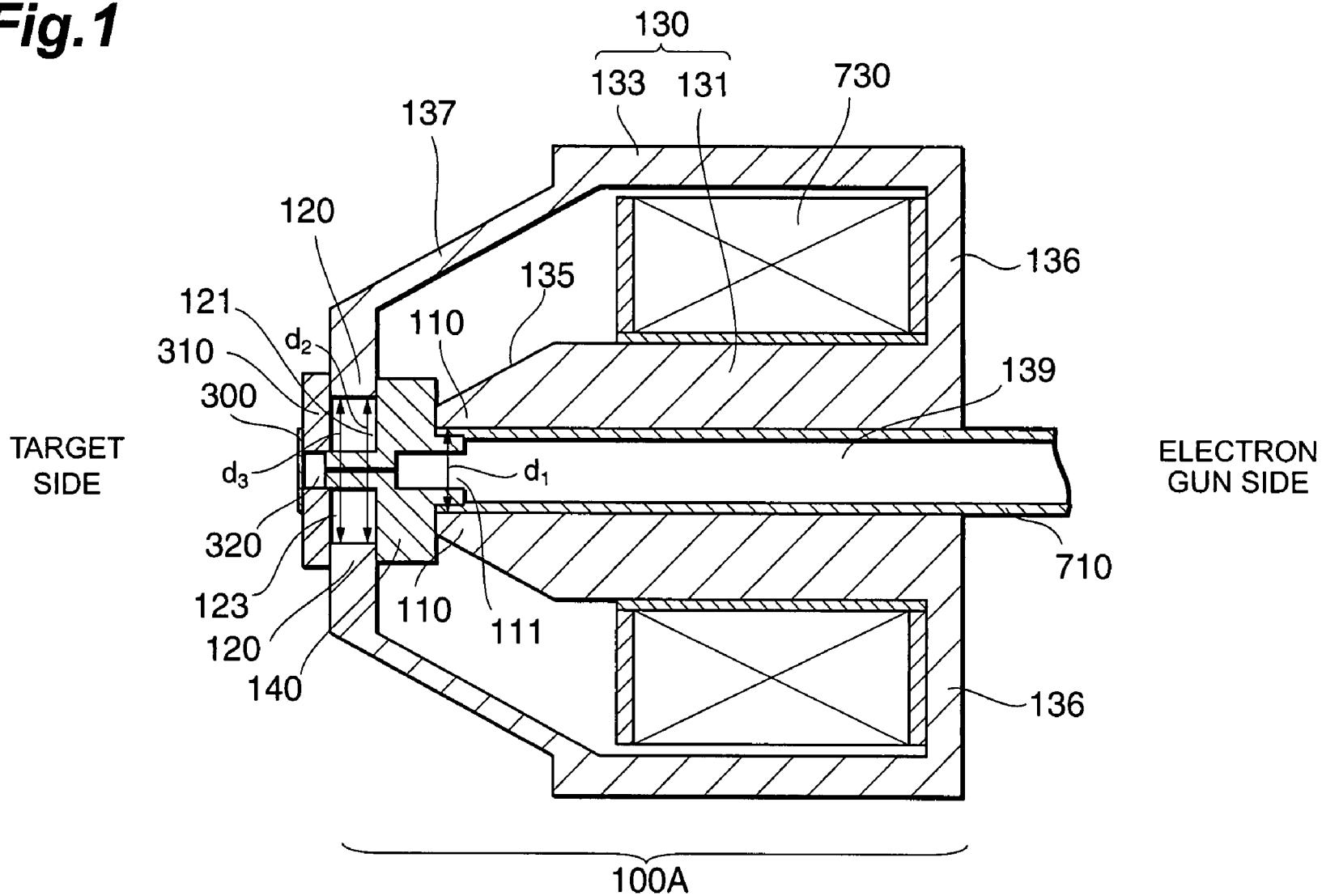
FIG. 1 is a sectional view of an electron lens forming part of an embodiment.

Electron lens forming part 100A shall now be described in detail. FIG. 1 is a sectional view of electron lens forming part 100A. Electron lens forming part 100A is equipped with a yoke 130 formed of a ferromagnetic material. Yoke 130 is disposed in the direction coaxial to the tube axis direction of electron beam passage tube 710 (referred to hereinafter as the "tube axis direction") and includes a central axis part 131, which serves as the central axis of yoke 130, and an outer peripheral part 133, which is disposed in the direction coaxial to the tube axis direction at the surroundings of central axis part 131.

Outer peripheral part 133 has a cylindrical shape and is positioned with an interval being set with respect to central axis part 131. Coil part 730 is mounted at the electron beam side of the interval between outer peripheral part 133 and central axis part 131. Coil part 730 is disposed in the direction coaxial to the tube axis direction. Outer peripheral part 133 and central axis part 131 are connected at the electron gun side by a perpendicular part 136 that is perpendicular to the tube axis direction.

The front end parts 135 and 137 of central axis part 131 and outer peripheral part 133, respectively, are positioned at the target side. Front end parts 135 and 137 are narrowed in the direction towards the target. The tip of front end part 135 becomes the magnetic pole 110 that is positioned at the electron beam side. The tip of front end part 137 is bent in the direction perpendicular to the tube axis direction and this tip becomes the magnetic pole 120 that is positioned at the target side.

A predetermined gap is set between magnetic pole 110 and magnetic pole 120. A second opening 121 and a third opening 123 are defined by magnetic pole 120. The value of diameter d2 of second opening 121 is greater than the value of diameter d1 of a first opening 111. Also, the value of diameter d2 is equal to the value of diameter d3 of third opening 123.

A through hole 139, extending in the tube axis direction, is formed in central axis part 131. Through hole 139 serves as a path for guiding the electron beam generated by the electron gun to first opening 111. Electron beam passage tube 710 is inserted in through hole 139. The electron beam generated at the electron gun passes through electron beam passage tube 710, is guided to first opening 111, and is emitted from first opening 111. The electron beam emitted from first opening 111 enters second opening 121. The electron beam that has entered second opening 121 is emitted towards target 300 from third opening 123.

A spacer 140 is positioned at the gap formed between magnetic pole 110 and magnetic pole 120. The material of spacer 140 is, for example, stainless steel. An electron beam passage hole 141 is formed in spacer 140. Of the electron beams converged by the electron lens, the electron beam that passes near the center of the electron lens (referred to hereinafter as the "central electron beam") passes through electron beam passage hole 141 and is guided to target 300. The electron beam that does not pass near the center of the electron lens (referred to hereinafter as the "peripheral electron beam") is cut by spacer 140 and does not reach target 300. That is, the central electron beam is used for the generation of X-rays and the peripheral electron beam is not used for the generation of X-rays. The peripheral electron beam would reach the one surface of target 300 upon spreading widely due to the aberration of the electron lens. The X-rays that are generated there by become background noise that is a cause of degradation of the image quality of the X-ray image. Electron beam passage 141 is thus formed so that only the central electron beam, which has not been affected readily by lens aberration, is used for the generation of X-rays.

Spacer 140 also has a function of keeping the length of the gap between magnetic pole 110 and magnetic pole 120 at a fixed value. When the length of the gap changes, the magnetic flux that leaks from the gap changes and thus the shape of the electron lens changes. This prevents the obtaining of the desired X-ray focal diameter.

A target holding part 310 is mounted onto front end part 137 so as to cover third opening 123. Target holding part 310 has a through hole 320 through which the electron beam emitted from third opening 123 passes. Target 300 is vapor deposited onto the surface of target holding part 310 so as to cover through hole 320. Target holding part 310 is made detachable from front end part 137. Thus when target 300 is consumed by use of transmission type X-ray tube 1000, target holding part 300 can be replaced by a new target holding part onto which a target has been vapor deposited.

[Effects of the Embodiment]

The effects of the present embodiment shall now be described. As shown in FIG. 1, with electron lens forming part 100A of the present embodiment, the value of diameter d2 of second opening 121 is greater than the value of diameter d1 of first opening 111. The X-ray focal diameter can thus be made small and transmission type X-ray tube 1000 can be made high in resolution. This shall now be described in detail.

Figure 3:
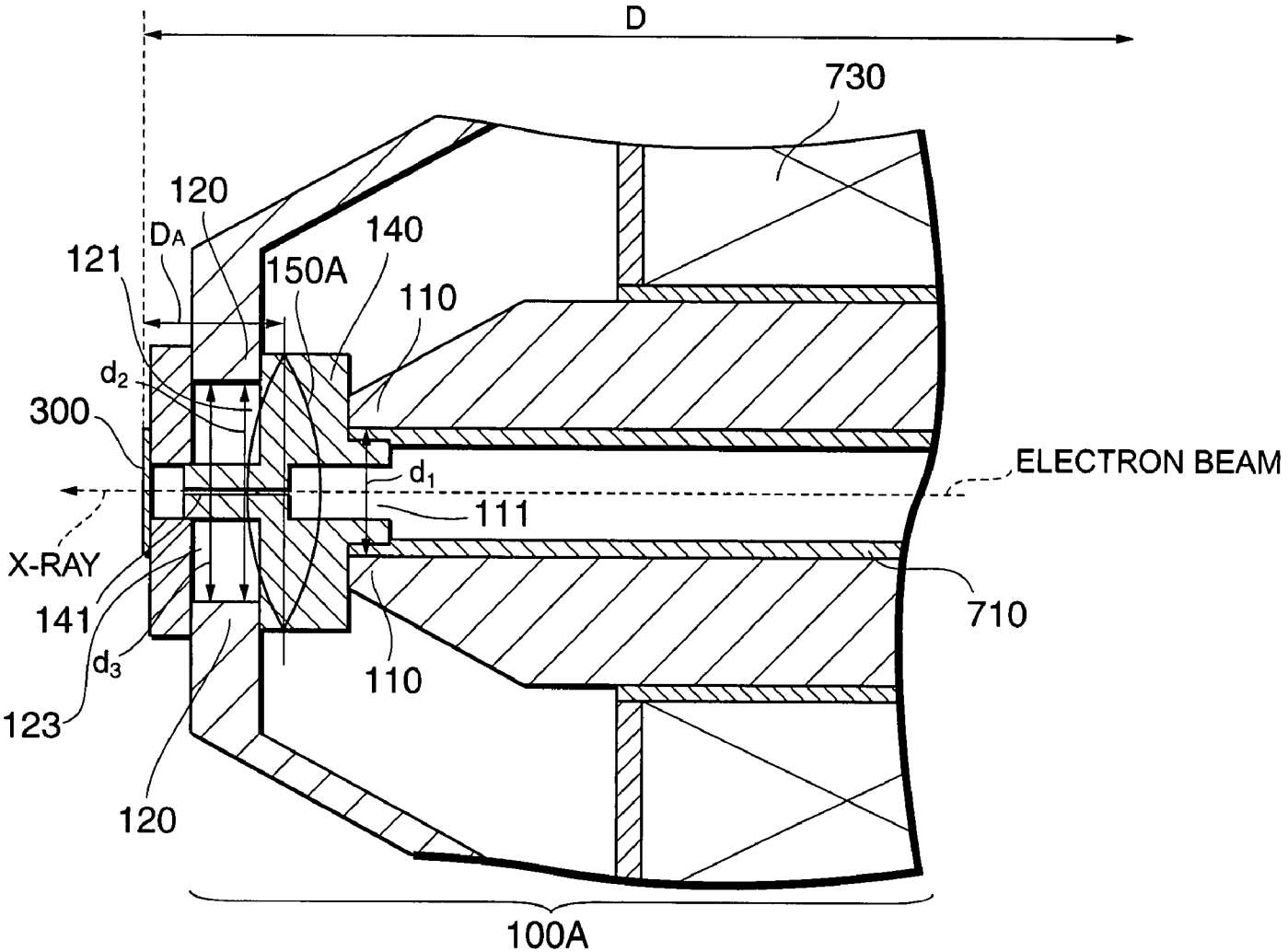
FIG. 3 is a sectional view of the electron lens forming part of the embodiment in a state in which an electron lens is formed.

FIG. 3 is a sectional view of electron lens forming part 100A in a state in which an electron lens is formed. FIG. 3 is an enlarged view of FIG. 1. Electron lens 150A of the embodiment is an electromagnetic lens. In other words, the magnetic field that is generated at the gap between magnetic pole 110 and magnetic pole 120 by making current flow through coil part 730 is used as a lens. The electron beam is converged by electron lens 150A. By the converged electron hitting the one surface of target 300, X-rays are radiated from the other surface of target 300. The manner of convergence of the electron beam changes according to the shape of the magnetic field distribution.

Figure 4:
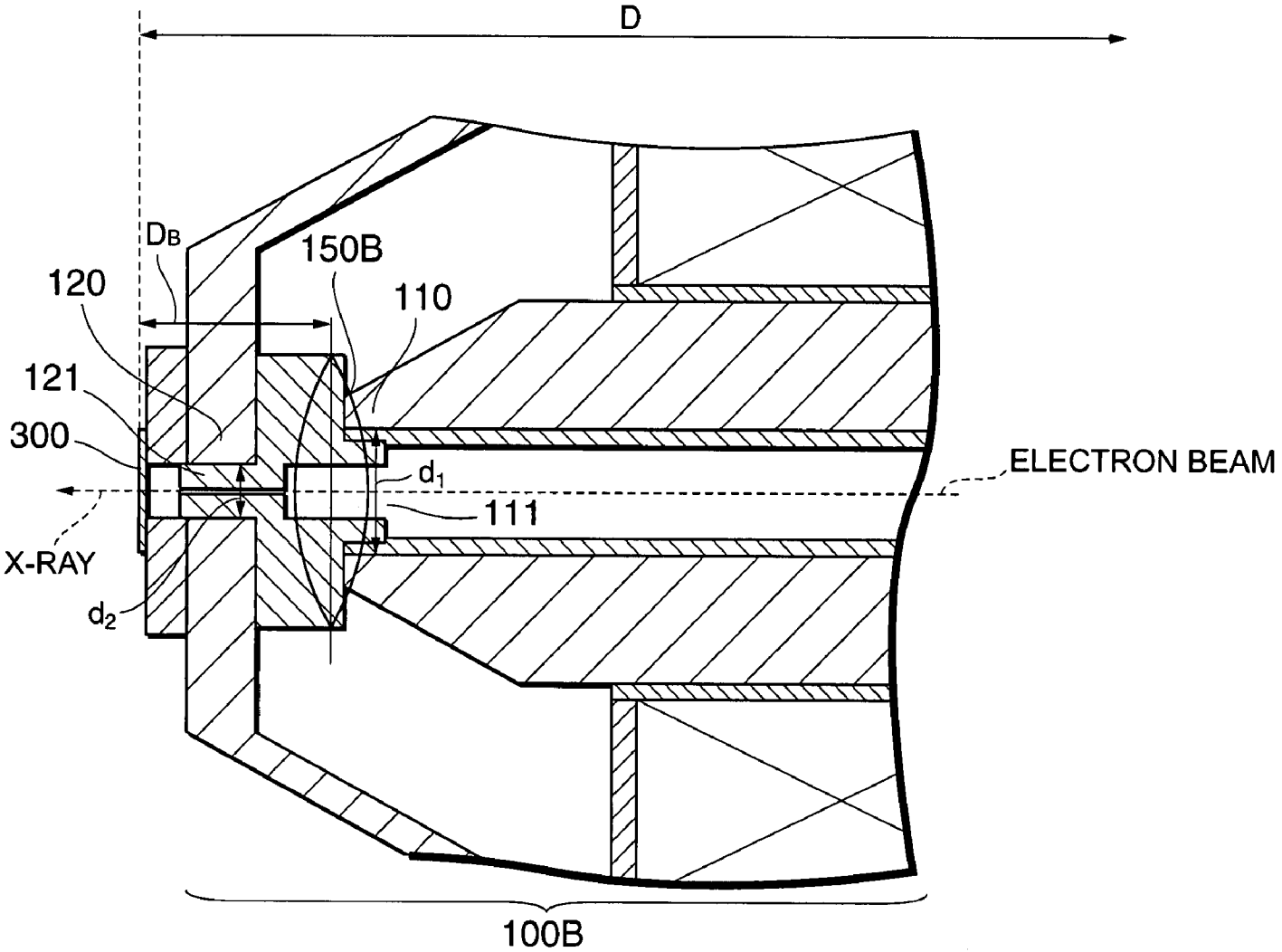
FIG. 4 is a sectional view of an electron lens forming part of a comparative example in a state in which an electron lens is formed.

FIG. 4 shows a comparative example and shows an electron lens forming part 100B in a state in which an electron lens 150B is formed. The same parts as those indicated by the symbols of FIG. 3 are provided with the same symbols. The difference with respect to electron lens forming part 100A lies in the relationship between the value of diameter d1 and the value of diameter d2. With electron lens forming part 100B, the value of diameter d1 is greater than the value of diameter d2. As can be understood from FIGS. 3 and 4, as the value of diameter d2 is made greater than the value of diameter d1, the electron lens forming position becomes closer to the target 300 side.

For electron lens forming parts 100A and 100B, let the distance from a hypothetical point near the cathode (that is, electron gun 200) to target 300 be D. Let the distance from the center of the electron lens to the target be $D_A$ in the case of electron lens forming part 100A and $D_B$ in the case of electron lens forming part 100B.

The magnification $M_A$ of the electron lens system of electron lens forming part 100A is $D_A/D$. Meanwhile, the magnification $M_B$ of the electron lens system of electron lens forming part 100B is $D_B/D$. Since the distance $D_A$ is less than the distance $D_B$, the magnification $M_A$ is smaller than the magnification $M_B$. Electron lens 150A can thus make the diameter of the beam incident on target 300 smaller than electron lens 150B.

Figure 5:
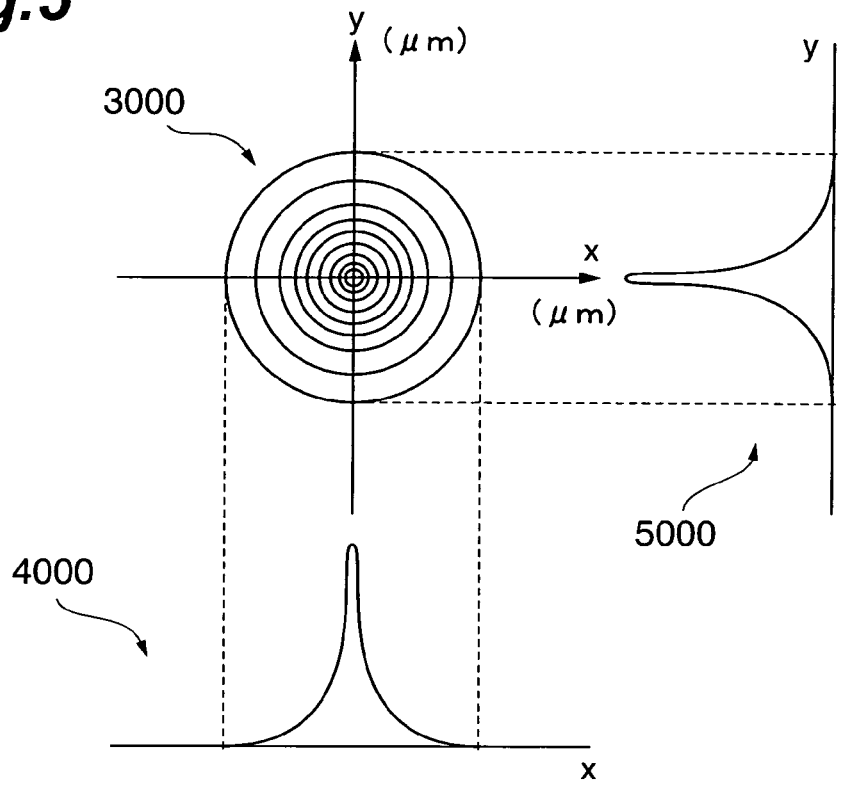
FIG. 5 is a diagram schematically showing an electron beam that is made incident on a target in the embodiment.
Figure 6:
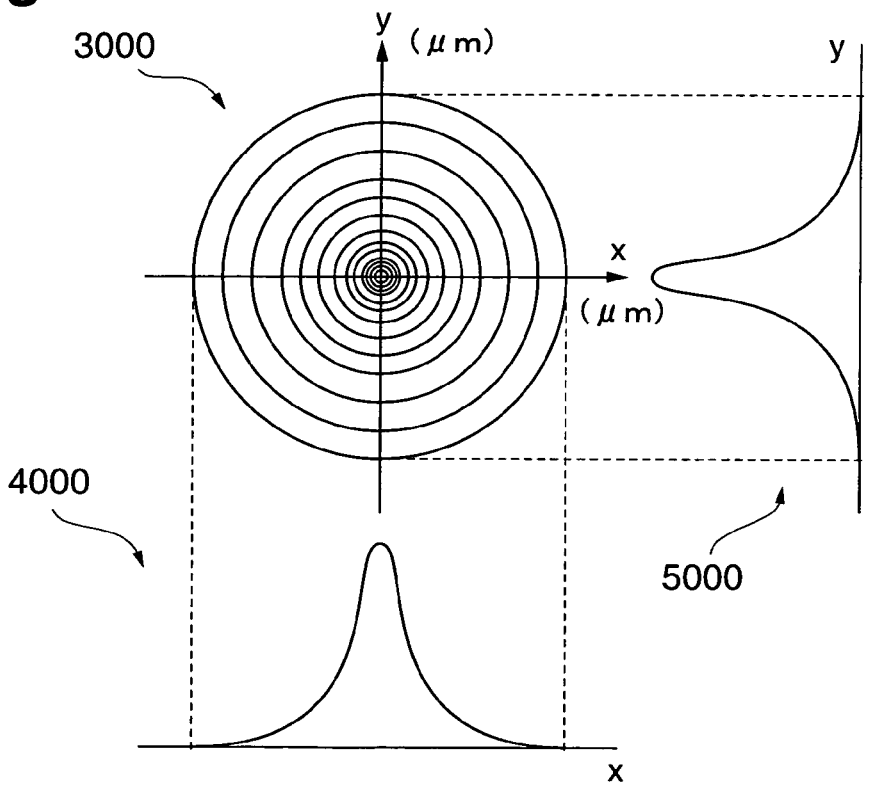
FIG. 6 is a diagram schematically showing an electron beam that is made incident on a target in the comparative example.

FIG. 5 is a diagram schematically showing an electron beam that is made incident on target 300 in the present embodiment. FIG. 6 is a diagram schematically showing an electron beam that is made incident on target 300 in the comparative example shown in FIG. 4. Symbol 3000 schematically indicates a plane of the electron beam on target 300. Symbol 4000 indicates the density of the electron beam at a part passing through the central part of the electron beam in the x direction on target 300. Symbol 5000 indicates the density of the electron beam at a part passing through the central part of the electron beam in the y direction on target 300.

Figure 7:
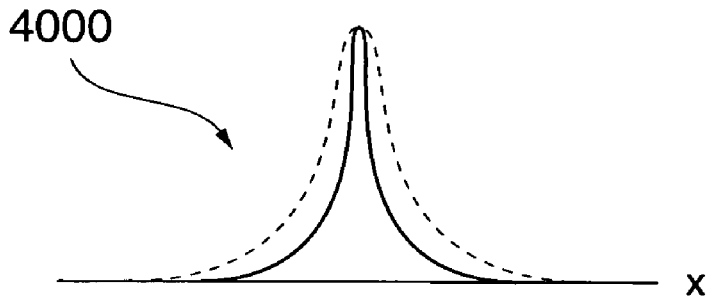
FIG. 7 is a diagram comparing the graph indicated by symbol 4000 in FIG. 5 and the graph indicated by symbol 4000 in FIG. 6.
Figure 8:
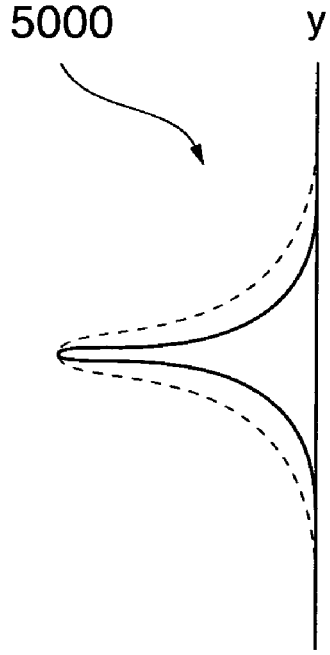
FIG. 8 is a diagram comparing the graph indicated by symbol 5000 in FIG. 5 and the graph indicated by symbol 5000 in FIG. 6.

FIG. 7 is a diagram comparing the graph indicated by symbol 4000 in FIG. 5 and the graph indicated by symbol 4000 in FIG. 6. FIG. 8 is a diagram comparing the graph indicated by symbol 5000 in FIG. 5 and the graph indicated by symbol 5000 in FIG. 6. In FIG. 7 and FIG. 8, the solid line corresponds to the present embodiment and the dotted line corresponds to the comparative example. The spreading of the electron beam is smaller with the present embodiment than with the comparative example.

Based on the above, the present inventor found that when the value of diameter d2 of second opening 121 is greater than or equal to the value of diameter d1 of first opening 111, that is, when the value of diameter d2 is equal to or is greater than the value of diameter d1, the X-ray focal diameter becomes less than or equal to the X-ray focal diameter required by the inventor. Since the X-ray focal diameter can thus be made small with the present embodiment, transmission type X-ray tube 1000 can be made high in resolution.

[Descriptions of Modification Examples of the Electron Lens Forming Part]

Modification examples of the present embodiment's electron lens forming part shall now be described. Components that are the same as the components of electron lens forming part 100A shown in FIG. 1 are provided with the same symbols.

Modification Example 1

Figure 9:
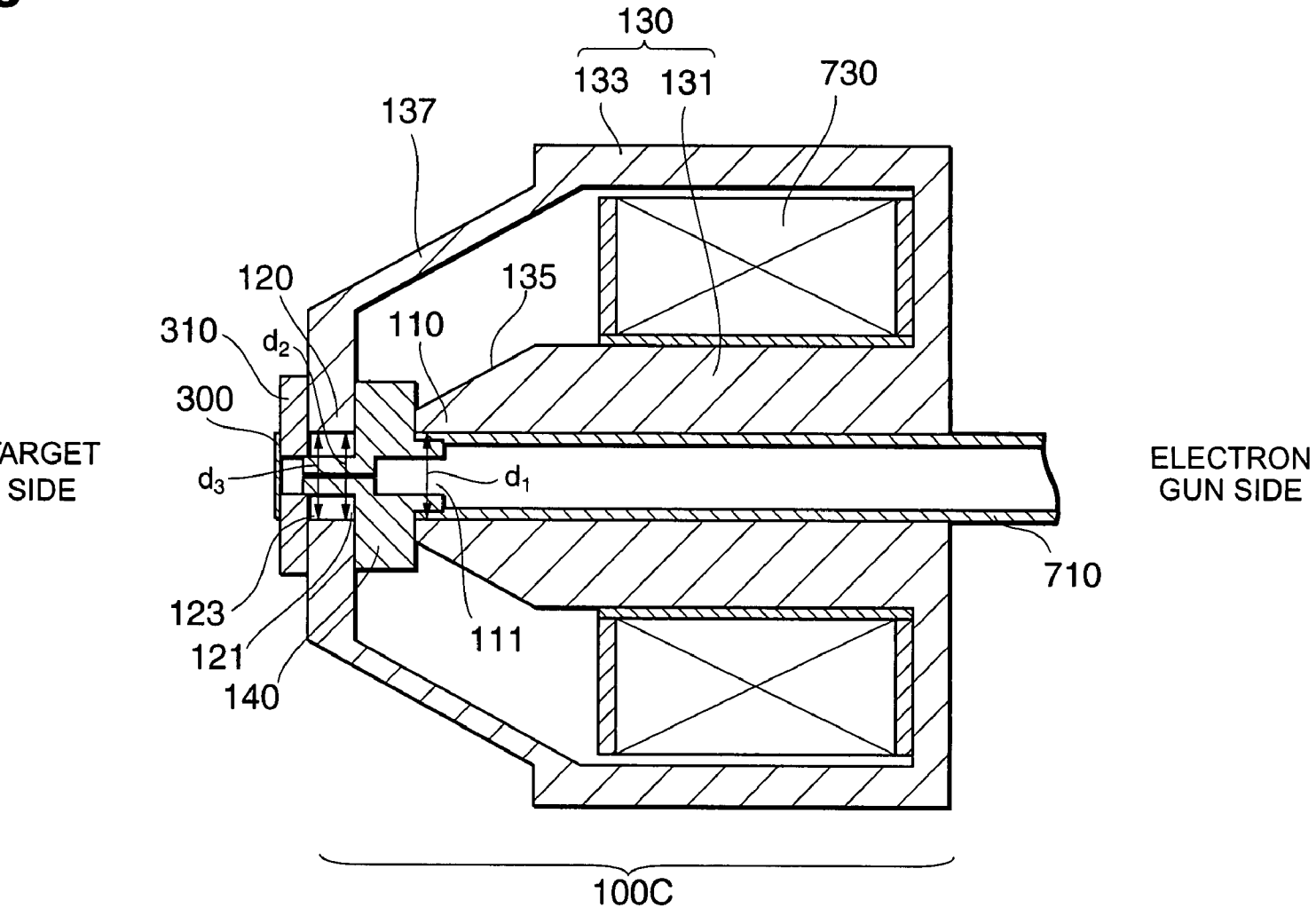
FIG. 9 is a sectional view of a first modification example of the electron lens forming part of the embodiment.

FIG. 9 is a sectional view of a first modification example of the electron lens forming part of the embodiment. Electron lens forming part 100C shown in FIG. 9 differs from electron lens forming part 100A in the diameters of the openings. That is, with electron lens forming part 100C, the value of diameter d2 of second opening is equal to the value of diameter d1 of first opening 111. As mentioned above, when the value of diameter d2 is equal to the value of diameter d1, the diameter of the electron beam that is made incident on target 300 can be made smaller than when the value of diameter d2 of second opening 121 is less than diameter d1 of first opening 111 as shown in FIG. 4. The X-ray focal diameter can thereby be made small and transmission type X-ray tube 1000 can be made high in resolution. With electron lens forming part 100C, the value of diameter d2 of second opening 121 is equal to the value of diameter d3 of third opening 123.

Modification Example 2

Figure 10:
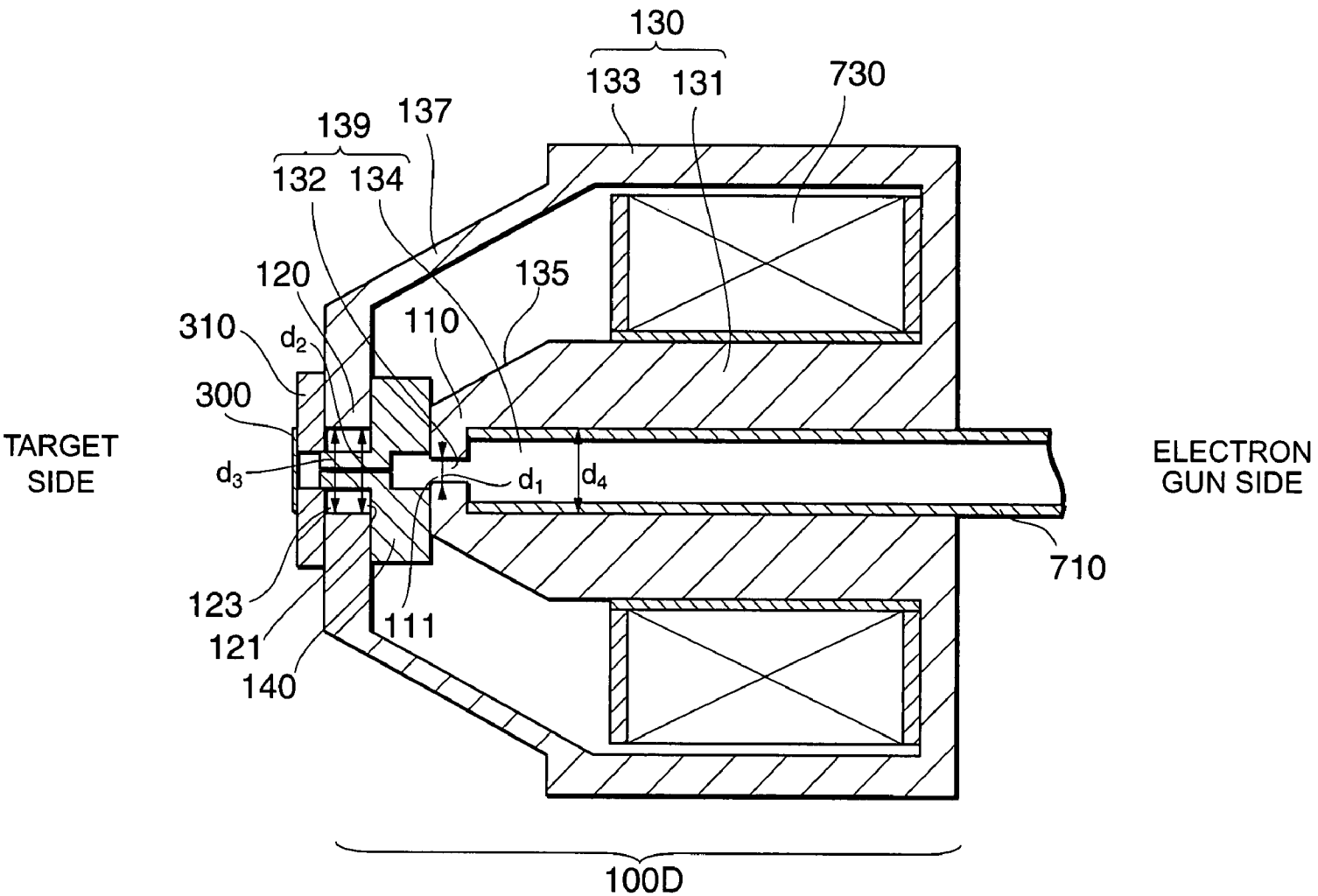
FIG. 10 is a sectional view of a second modification example of the electron lens forming part of the embodiment.

FIG. 10 is a sectional view of a second modification example of the electron lens forming part of the embodiment. As with electron lens forming part 100A, electron lens forming part 100D shown in FIG. 10 is arranged so that the value of diameter d2 of second opening 121 is greater than the value of diameter d1 of first opening 111 and the value of diameter d2 of second opening 121 is equal to the value of diameter d3 of third opening 123.

Electron lens forming part 100D differs from electron lens forming part 100A in the shape of through hole 139 formed in central axis part 131. Through hole 139 includes a first part 132, positioned at the target side, and a second part 134, positioned at the electron gun side. First part 132 includes first opening 111. Electron beam passage tube 710 is inserted into second part 134 of through hole 139. The value of diameter d4 of second part 134 is greater than the value of diameter d1 of first part 132. With electron lens forming part 100D, since the value of diameter d1 of first part 132 can be made small, the current that is made to flow through coil part 730 in the process of forming the electron lens can be made small.

Modification Example 3

Figure 11:
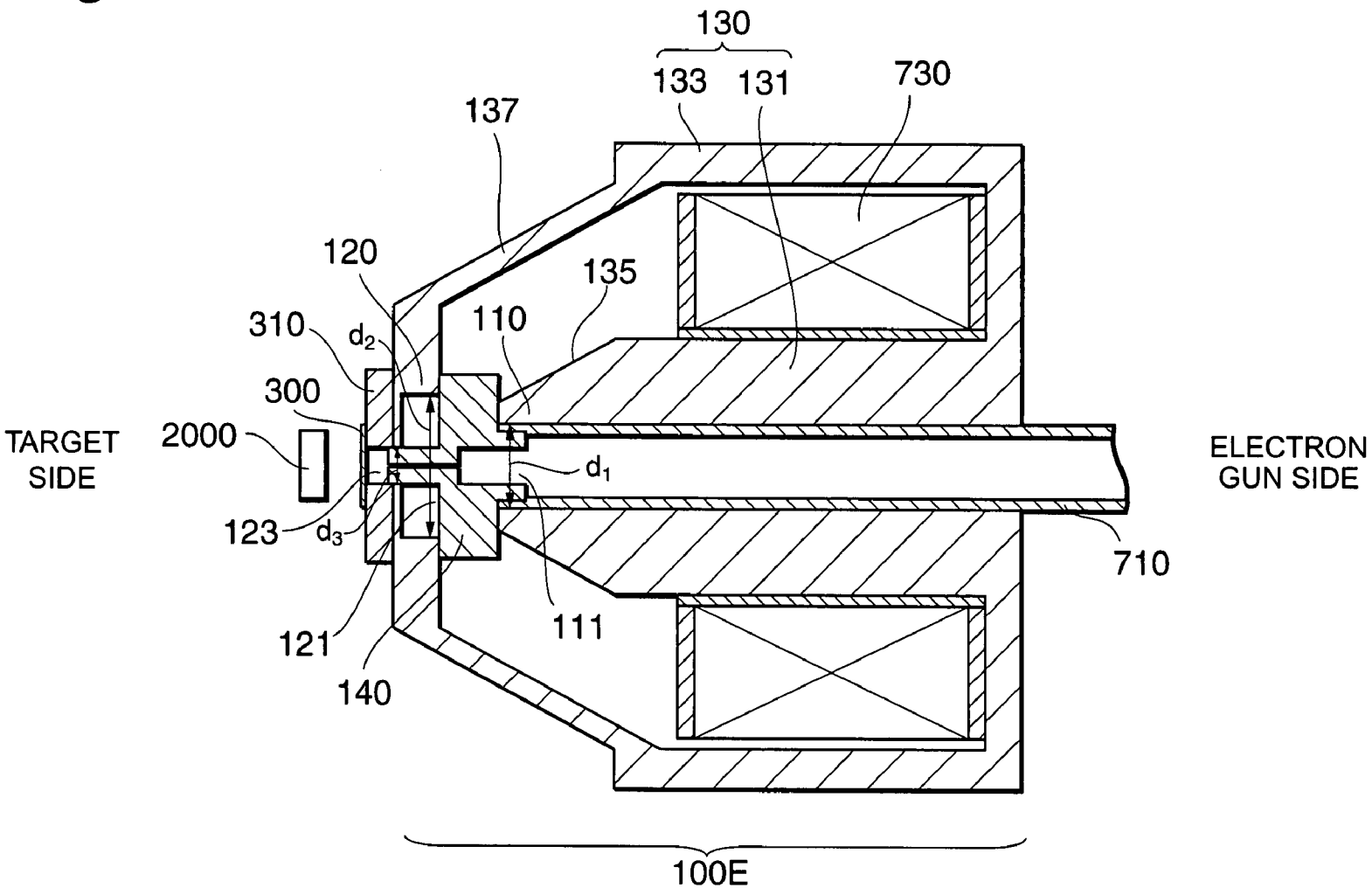
FIG. 11 is a sectional view of a third modification example of the electron lens forming part of the embodiment.

FIG. 11 is a sectional view of a third modification example of the electron lens forming part of the embodiment. As with electron lens forming part 100A, electron lens forming part 100E shown in FIG. 11 is arranged so that the value of diameter d2 of second opening 121 is greater than the value of diameter d1 of first opening 111. Electron lens forming part 100E differs from electron lens forming part 100A in that the value of diameter d3 of third opening 123 is less than the value of diameter d2 of second opening 121. The effects of this shall now be described.

For example, in performing non-destructive inspection of a measured object 2000, measured object 2000 is set near the surface of target 300 from which X-rays are radiated. As described above, since the magnetic field distribution (electron lens) spreads towards the target side with the present embodiment, the magnetic field distribution may spread to the location at which measured object 2000 is set in some cases. The performance of measured object 2000 may degrade due to this magnetic field. Also, if measured object 2000 is a magnetic object, the shape of the magnetic field distribution, that is, the shape of the electron lens may change. The condition of convergence of the electron beam may then change due to the change in the shape of the electron lens.

With electron lens forming part 100E, since the value of diameter d3 of third opening 123 is less than the value of diameter d2 of second opening 121, the spreading of the magnetic field distribution to the location at which measured object 2000 is set can be prevented.

Modification Example 4

Figure 12:
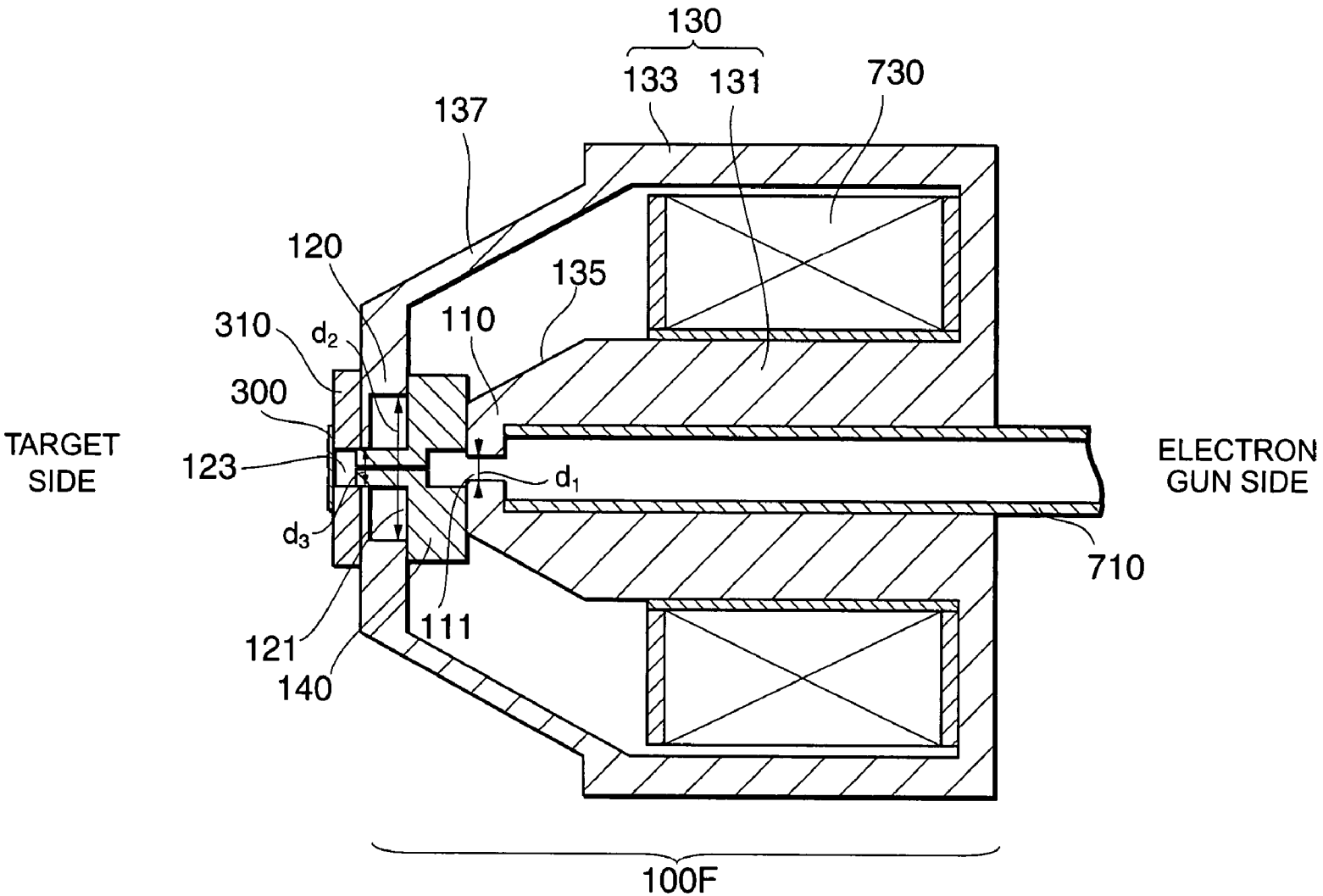
FIG. 12 is a sectional view of a fourth modification example of the electron lens forming part of the embodiment.

FIG. 12 is a sectional view of a fourth modification example of the electron lens forming part of the embodiment. With electron lens forming part 100F shown in FIG. 12, the value of diameter d1 of first opening 111 is made equal to the value of diameter d1 of first opening 111 of electron lens 100D shown in FIG. 10. Also with electron lens forming part 100F, the value of diameter d2 of second opening 121 is made equal to the value of diameter d2 of second opening 121 of electron lens 100E shown in FIG. 11. Furthermore with electron lens forming part 100F, the value of diameter d3 of third opening 123 is made equal to the value of diameter d3 of third opening 123 of electron lens 100E. Electron lens forming part 100F thus exhibits the effects of Modification Example 2 and the effects of Modification Example 3.

In lens forming parts 100D, 100E, and 100F of Modification Examples 2, 3, and 4, the value of diameter d2 of second opening 121 is greater than the value of diameter d1 of first opening 111, however, the value of diameter d2 may be made equal to the value of diameter d1 as in electron lens forming part 100C.

INDUSTRIAL APPLICABILITY

In an X-ray generating device according to the present invention, the value of the diameter of the second opening formed at the magnetic pole at the target side is greater than or equal to the diameter of the first opening formed at the magnetic pole at the electron beam generating means side. The electron lens forming position can thus be made close to the target side and the X-ray focal diameter can thus be made small. Thus by the present invention, the X-ray generating device can be made high in resolution.

The invention claimed is:

1. An X-ray generating device, wherein an electron beam is made to hit one surface of a target to make X-rays be radiated from the other surface of said target, said X-ray generating device comprising:

an electron beam generating means; and an electron lens forming means, including one magnetic pole positioned at said electron beam generating means side and the other magnetic pole positioned at said target side, and for making the electron beam converge by using the magnetic field generated by these magnetic poles, said one magnetic pole having a first opening from which the electron beam generated by said electron beam generating means is emitted, said other magnetic pole having a second opening into which the electron beam emitted from said first opening enters, and the value of the diameter of said second opening being greater than the value of the diameter of said first opening, wherein said other magnetic pole has a third opening that emits, towards said target, the electron beam that has entered into said second opening, the target being fixed in a position that covers one end of the third opening.

2. The X-ray generating device as set forth in claim 1, wherein the value of the diameter of said third opening is smaller than the value of the diameter of said second opening.

3. The X-ray generating device as set forth in claim 2, wherein the value of the diameter of said third opening is smaller than the value of the diameter of said first opening.

4. The X-ray generating device as set forth in claim 2, wherein the value of the diameter of said third opening is greater than the value of the diameter of said first opening.

5. The X-ray generating device as set forth in claim 2, wherein the value of the diameter of said third opening is equal to the value of the diameter of said first opening.

6. The X-ray generating device as set forth in claim 1:

wherein said one magnetic pole of said electron lens forming means comprises a ferromagnetic part having a through hole;

wherein said through hole is arranged as a path for guiding the electron beam generated by said electron beam generating means to said first opening;

wherein said through hole has a first part, positioned at said target side and having a first diameter, and a second part, positioned at said electron beam generating means side and having a second diameter which is greater in value than the diameter of said first part; and wherein said first part includes said first opening.

7. The X-ray generating device as set forth in claim 1, further comprising means that guides, to said target, only the electron beam, which, among the electron beams that enter said electron lens, passes near the center of said electron lens.

8. The X-ray generating device as set forth in claim 1, further comprising means for keeping constant the length of the gap between said one magnetic pole and said other magnetic pole.

9. An X-ray generating device, wherein an electron beam is made to hit one surface of a target to make X-rays be radiated from the other surface of said target, said X-ray generating device comprising:

an electron beam generating means; and an electron lens forming means, including one magnetic pole positioned at said electron beam generating means side and the other magnetic pole positioned at said target side, and for making the electron beam converge by using the magnetic field generated by these magnetic poles; and a spacer positioned between the magnetic poles so as to maintain the length of the gap between the magnetic poles at a fixed value, said one magnetic pole having a first opening from which the electron beam generated by said electron beam generating means is emitted, said other magnetic pole having a second opening into which the electron beam emitted from said first opening enters, the value of the diameter of said second opening being greater than or equal to the value of the diameter of said first opening.

10. The X-ray generating device as set forth in claim 9, wherein said other magnetic pole has a third opening that emits, towards said target, the electron beam that has entered into said second opening, and the value of the diameter of said third opening is smaller than the value of the diameter of said second opening.

11. The X-ray generating device as set forth in claim 10, wherein the value of the diameter of said third opening is smaller than the value of the diameter of said first opening.

12. The X-ray generating device as set forth in claim 10, wherein the value of the diameter of said third opening is greater than the value of the diameter of said first opening.

13. The X-ray generating device as set forth in claim 10, wherein the value of the diameter of said third opening is equal to the value of the diameter of said first opening.

14. The X-ray generating device as set forth in claim 9:

wherein said one magnetic pole of said electron lens forming means comprises a ferromagnetic part having a through hole;

wherein said through hole is arranged as a path for guiding the electron beam generated by said electron beam generating means to said first opening;

wherein said through hole has a first part, positioned at said target side and having a first diameter, and a second part, positioned at said electron beam generating means side and having a second diameter which is greater in value than the diameter of said first part; and wherein said first part includes said first opening.

15. The X-ray generating device as set forth in claim 9, further comprising means that guides, to said target, only the electron beam, which, among the electron beams that enter said electron lens, passes near the center of said electron lens.

16. The X-ray generating device as set forth in claim 9, wherein the spacer is attached to each of the magnetic poles.

17. The X-ray generating device as set forth in claim 9, wherein the spacer includes a through hole for electron beam passage, the through hole being larger in diameter at the electron generating side than at the target side.

18. The X-ray generating device as set forth in claim 9 wherein the spacer includes two ends, a first end being inserted into the first opening and a second end being inserted into the second opening.

* * * * *